US008162556B2

(12) United States Patent
Cheng et al.

(10) Patent No.: US 8,162,556 B2
(45) Date of Patent: Apr. 24, 2012

(54) ACTUATOR FOR A RING BINDER MECHANISM

(75) Inventors: Ho Ping Cheng, Hong Kong (HK); Ming Hua Huang, Hubei Province (CN)

(73) Assignee: World Wide Stationery Mfg. Co., Ltd., Kwai Chung, N.T. (HK)

( * ) Notice: Subject to any disclaimer, the term of this patent is extended or adjusted under 35 U.S.C. 154(b) by 588 days.

(21) Appl. No.: 12/346,551

(22) Filed: Dec. 30, 2008

(65) Prior Publication Data

US 2010/0166490 A1 Jul. 1, 2010

(51) Int. Cl.
*B42F 13/20* (2006.01)

(52) U.S. Cl. ..... 402/41; 402/38; 402/43

(58) Field of Classification Search ..... 402/38, 402/41, 43

See application file for complete search history.

(56) References Cited

U.S. PATENT DOCUMENTS

| | | | |
|---|---|---|---|
| 566,717 | A | 8/1896 | Krah |
| 651,254 | A | 6/1900 | Krah |
| 683,019 | A | 9/1901 | Buchanan |
| 790,382 | A | 5/1905 | McBride |
| 857,377 | A | 6/1907 | Baker |
| 974,831 | A | 11/1910 | Scherzinger |
| 1,163,179 | A | 12/1915 | Schade, Jr. |
| 1,398,034 | A | 11/1921 | Mero |
| 1,398,388 | A | 11/1921 | Murphy |
| 1,733,548 | A | 10/1929 | Martin |
| 1,733,894 | A | 10/1929 | Martin |
| 1,787,957 | A | 1/1931 | Schade |
| 1,953,981 | A | 4/1934 | Trussell |
| 1,991,362 | A | 2/1935 | Krag |
| 1,996,463 | A | 4/1935 | Dawson et al. |
| 2,004,570 | A | 6/1935 | Dawson |
| 2,013,416 | A | 9/1935 | McClure |
| 2,024,461 | A | 12/1935 | Lotter |
| 2,075,766 | A | 3/1937 | Rand |
| 2,089,211 | A | 8/1937 | Krag |
| 2,096,944 | A | 10/1937 | Unger et al. |
| 2,103,307 | A | 12/1937 | Unger |

(Continued)

FOREIGN PATENT DOCUMENTS

EP 1065072 A2 1/2001

(Continued)

OTHER PUBLICATIONS

Cyber Comfort ad sheet, Apr. 2003, 2 pgs, World Wide Stationery Mfg. Co., Ltd., Hong Kong.

*Primary Examiner* — Dana Ross
*Assistant Examiner* — Matthew G Katcoff
(74) *Attorney, Agent, or Firm* — Senniger Powers LLP

(57) ABSTRACT

A ring binder mechanism includes an elongate housing and a ring support supported by the housing for movement relative to the housing. The ring support has an upper surface and a lower surface. A plurality of rings is provided for holding loose-leaf pages. Each ring includes a first ring member and a second ring member. The first ring member is mounted on the ring support for movement with the ring support relative to the housing between a closed position and an opened position. An actuator is mounted on the housing for pivotal movement relative to the housing for moving the rings from their closed position to their opened position. The actuator has a snap-lock connection with the housing.

12 Claims, 19 Drawing Sheets

U.S. PATENT DOCUMENTS 2,105,235 A 1/1938 Schade
2,158,056 A 5/1939 Cruzan
2,179,627 A 11/1939 Handler
2,204,918 A 6/1940 Trussell
2,218,105 A 10/1940 Griffin
2,236,321 A 3/1941 Ostrander
2,239,121 A 4/1941 St. Louis et al.
2,252,422 A 8/1941 Unger
2,260,929 A 10/1941 Bloore
2,288,189 A 6/1942 Guinane
2,304,716 A 12/1942 Supin
2,311,492 A 2/1943 Unger
2,322,595 A 6/1943 Schade
2,421,799 A 6/1947 Martin
2,528,866 A 11/1950 Dawson, Jr.
2,612,169 A 9/1952 Segal
2,865,377 A 12/1958 Schroer et al.
2,871,711 A 2/1959 Stark
2,891,553 A 6/1959 Acton
2,950,719 A 8/1960 Lyon
3,077,888 A 2/1963 Thieme
3,098,489 A 7/1963 Vernon
3,098,490 A 7/1963 Wance
3,101,719 A 8/1963 Vernon
3,104,667 A 9/1963 Mintz
3,149,636 A 9/1964 Rankin
3,190,293 A 6/1965 Schneider et al.
3,205,894 A 9/1965 Rankin
3,205,895 A 9/1965 Johnson
3,255,759 A 6/1966 Dennis
3,348,550 A 10/1967 Wolf et al.
3,718,402 A 2/1973 Schade
3,748,051 A 7/1973 Frank
3,884,586 A 5/1975 Michaelis et al.
3,954,343 A 5/1976 Thomsen
3,993,374 A 11/1976 Schudy et al.
4,127,340 A 11/1978 Almgren
4,130,368 A 12/1978 Jacoby et al.
4,352,582 A 10/1982 Eliasson
4,522,526 A 6/1985 Lozfau et al.
4,566,817 A 1/1986 Barrett, Jr.
4,571,108 A 2/1986 Vogl
4,696,595 A 9/1987 Pinkney
4,798,491 A 1/1989 Lassle
4,813,803 A 3/1989 Gross
4,815,882 A 3/1989 Ohminato
4,886,390 A 12/1989 Silence et al.
4,919,557 A 4/1990 Podosek
5,067,840 A 11/1991 Cooper et al.
5,116,157 A 5/1992 Gillum et al.
5,135,323 A 8/1992 Pinheiro
5,180,247 A 1/1993 Yu
5,255,991 A * 10/1993 Sparkes ..... 402/38
5,286,128 A 2/1994 Gillum
5,346,325 A * 9/1994 Yamanoi ..... 402/38
5,354,142 A 10/1994 Yu
5,368,407 A 11/1994 Law
5,378,073 A 1/1995 Law
5,393,155 A 2/1995 Ng
5,393,156 A 2/1995 Mullin et al.
5,476,335 A 12/1995 Whaley
5,660,490 A 8/1997 Warrington
5,692,847 A 12/1997 Zane et al.
5,692,848 A 12/1997 Wada
5,718,529 A 2/1998 Chan
5,782,569 A 7/1998 Mullin et al.
5,788,392 A 8/1998 Cheung
5,807,006 A 9/1998 Cheung
5,810,499 A 9/1998 Law
5,816,729 A 10/1998 Whaley
5,868,513 A 2/1999 Law
5,879,097 A 3/1999 Cheng
5,904,435 A 5/1999 Tung
5,957,611 A 9/1999 Whaley
5,975,785 A 11/1999 Chan
6,036,394 A 3/2000 Cheng
6,146,042 A 11/2000 To et al.
6,206,601 B1 3/2001 Ko
6,217,247 B1 4/2001 Ng
6,270,279 B1 8/2001 Whaley
6,276,862 B1 8/2001 Snyder
6,293,722 B1 9/2001 Holbrook et al.
6,364,558 B1 4/2002 To
6,467,984 B1 10/2002 To
6,474,897 B1 11/2002 To
6,533,486 B1 3/2003 To
6,536,980 B2 3/2003 To
6,749,357 B2 * 6/2004 Cheng ..... 402/19
6,840,695 B2 1/2005 Horn
7,223,040 B2 5/2007 Koike et al.
7,270,496 B2 9/2007 Morgan et al.
7,296,946 B2 11/2007 Cheng et al.
7,331,732 B2 2/2008 Kaneda
7,404,685 B2 7/2008 Cheng
7,478,963 B2 1/2009 Tanaka et al.
7,534,064 B2 5/2009 Cheng
7,549,817 B2 6/2009 Cheng et al.
7,648,302 B2 1/2010 Zhang et al.
7,665,926 B2 2/2010 Cheng
7,674,062 B2 3/2010 Horn
7,819,602 B2 10/2010 To et al.
7,828,491 B2 11/2010 Cheng
2002/0076262 A1 6/2002 To
2005/0201817 A1 9/2005 Cheng
2006/0008318 A1 1/2006 Ng
2006/0104708 A1 5/2006 Kaneda
2006/0216107 A1 9/2006 Lin
2007/0086836 A1 4/2007 Cheng
2008/0008519 A1 1/2008 To
2008/0085145 A1 4/2008 To et al.
2008/0199246 A1 8/2008 To et al.
2009/0035053 A1 2/2009 Pi et al.
2009/0060630 A1 3/2009 To et al.
2009/0060631 A1 3/2009 To et al.
2009/0110470 A1 4/2009 To et al.

FOREIGN PATENT DOCUMENTS

FR 1336765 A 9/1963
FR 1346864 A 12/1963
FR 2221924 A5 10/1974
FR 2238332 A5 2/1975
GB 868724 A 5/1961
GB 906279 A 9/1962
GB 952536 A 3/1964
GB 2292343 A 2/1996
GB 2387815 A 10/2003
JP 5979379 U 5/1984
JP 6118880 U 2/1986
JP 1299095 A 12/1989
JP 2034289 3/1990
JP 04120085 U 10/1992
JP 06171287 A 6/1994
JP 10217662 A 8/1998
JP 10329470 A 12/1998

* cited by examiner

ACTUATOR FOR A RING BINDER MECHANISM

BACKGROUND

The field of this invention relates generally to ring binder mechanisms for retaining loose-leaf pages, and in particular to an actuator for a ring binder mechanism.

Typical ring binder mechanisms have a plurality of rings for retaining loose-leaf pages, such as hole-punched pages, in a file or notebook. The rings can be selectively opened to add or remove pages from the ring binder mechanism or closed to retain the pages while allowing the pages to be moved along the rings. Each of the rings includes paired ring members mounted on adjacent hinge plates that are joined together about a pivot axis. A housing, which is typically metal and elongate, supports the hinge plates within the housing for pivotal movement relative to the housing about the pivot axis. Often, the housing is generally arch-shaped (e.g., U-shaped or C-shaped) in cross-section, with bent-under rims that hold the hinge plates within the housing.

The housing of the ring binder mechanism typically has an exposed metal outer surface. This exposed surface often contains nickel plating, to which some people may be sensitive. Additionally, it is difficult and costly to print on a metal surface particularly where the metal surface is nickel-plated. The process of nickel plating can also present some environmental and work hazard issues. Accordingly, it is known in some instances to replace the metal housing with a housing constructed from a polymeric material.

The metallic or polymeric housing, in an undeformed state, is slightly narrower than the joined hinge plates when the hinge plates are in a coplanar position. As the hinge plates pivot through this coplanar position, they deform the resilient housing laterally outwardly and cause a spring force in the housing to urge the hinge plates to pivot away from the coplanar position, either upward to open the rings or downward to close the rings. When the rings are closed, the spring force of the housing resists hinge plate movement and thereby holds the rings together. Similarly, when the rings are opened, the spring force of the housing holds them apart. Typically, an operator can overcome the spring force of the housing by manually pulling the ring members of the rings apart or pushing them together.

Actuators may be provided on one or both ends of the housing for pivoting the hinge plates and thereby moving the rings between their opened and closed positions. In one known configuration, the actuators may include an upper arm disposed adjacent the upper surface of the hinge plates and a lower arm disposed adjacent the lower surface of the hinge plates. As one of or both of the actuators are pivoted away from the housing, the lower arm contacts the lower surface of the hinge plates and drives the hinge plates upward through the coplanar position thereby opening the rings. To close the rings, the actuator or actuators are pivoted in the opposite direction (i.e., toward the housing) so that the upper arm contacts the upper surface of the hinge plates and drives the hinge plates downward through the coplanar position thereby closing the rings.

Prior art actuators are often mounted on the housing for pivotal movement relative thereto using metal pivot pins. Commonly, the pivot pin is aligned with and inserted through openings in both the housing and the actuator. Once the pivot pin is properly inserted, one or both of its ends are flared to secure the pivot pin in place. In the manufacture of ring binder mechanisms, wherein thousands, or millions, or even tens of millions of ring binder mechanisms can be produced in a single month, mounting the actuators to the housings using conventional pivot pins can add significant manufacturing time and costs.

Thus, there is a need for a more economic, easier, and faster method of mounting actuators to housings during the assembly of ring binder mechanisms and for an actuator that facilitates such a method.

SUMMARY

In one aspect, a ring binder mechanism for holding loose-leaf pages generally comprises an elongate housing, a ring support supported by the housing for movement relative to the housing, and a plurality of rings for holding the loose-leaf pages. The ring support has an upper surface and a lower surface. Each ring includes a first ring member and a second ring member. The first ring member is mounted on the ring support for movement with the ring support relative to the housing between a closed position and an opened position. In the closed position, the first and second ring members cooperatively form a substantially continuous, closed loop for allowing loose-leaf pages retained by the rings to be moved along the rings from one ring member to the other. In the opened position, the first and second ring members form a discontinuous, open loop for adding or removing loose-leaf pages from the rings. An actuator is mounted on the housing for pivotal movement relative to the housing for moving the rings from their closed position to their opened position. The actuator has a snap-lock connection with the housing.

In another aspect, an actuator for a ring binder mechanism generally comprises a yoke portion and a lever arm extending upward from the yoke portion. The yoke portion has a lower arm, an upper arm spaced above the lower arm, and a pair of outwardly extending pivot members. The pivot members are configured for snap-lock connection with the ring binder mechanism.

In yet another aspect, a method of assembling a ring binder mechanism generally comprises obtaining an elongate housing having longitudinal ends and securing a ring support to the housing for movement relative to the housing. The ring support has at least one ring member mounted on the ring support for movement with the ring support relative to the housing. An actuator is snapped onto one of the longitudinal ends of the elongate housing to thereby mount the actuator on the housing. The actuator is pivotable relative to the housing.

Other features will be in part apparent and in part pointed out hereinafter.

BRIEF DESCRIPTION OF THE DRAWINGS

Corresponding reference numbers indicate corresponding parts throughout the views of the drawings.

DETAILED DESCRIPTION OF THE DRAWINGS

Figure 1:
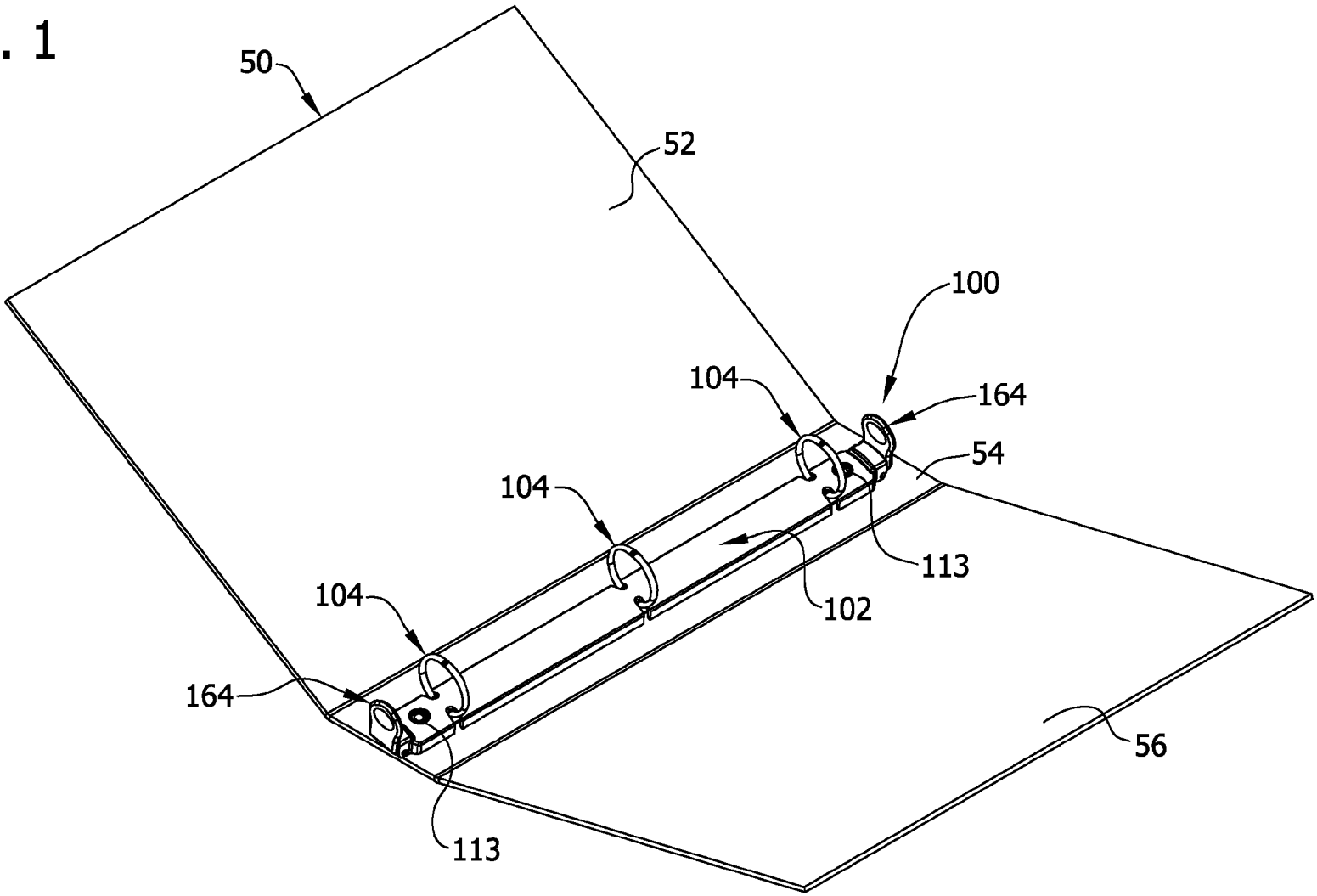
FIG. 1 is a perspective of a ring binder mechanism secured to a notebook.

With reference to FIG. 1, a ring binder mechanism, generally indicated at 100 is mounted on a notebook, which is designated generally at 50. The notebook 50 has a back cover 52, a spine 54, and a front cover 56. The front and back covers 56, 52 of the notebook 50 are hingedly connected to the spine 54 and are selectively moveable to cover or expose loose-leaf pages (not shown) retained by the ring binder mechanism 100. In the illustrated embodiment, the ring binder mechanism 100 is shown mounted on the spine 54 of the notebook 50 using rivets 113. It is contemplated, however, that the ring binder mechanism 100 can be mounted on other parts of the notebook 50 (e.g., on the back cover 52), using different types of fasteners (i.e., prong fasteners, screws), or on surfaces other than a notebook (e.g., a file) without departing from the scope of this invention. It is also contemplated that the ring binder mechanism 100 can be unmounted and be within the scope of the invention.

With reference to FIGS. 2-7, the ring binder mechanism 100 has a housing, indicated generally at 102, a pair of hinge plates 128 (together broadly defining, "a ring support") supported by the housing, and three rings, each of which is designated generally at 104, mounted on the hinge plates. The housing 102 is elongate and comprises a central portion 148 and lateral sides 150 extending downward in generally vertical planes along either side of the central portion between opposite longitudinal ends 140, 142. The arrangement of the central portion 148 and lateral sides 150 results in the housing having a generally arch-shaped (e.g., U-shaped) cross-section between the longitudinal ends 140, 142.

Figure 3:
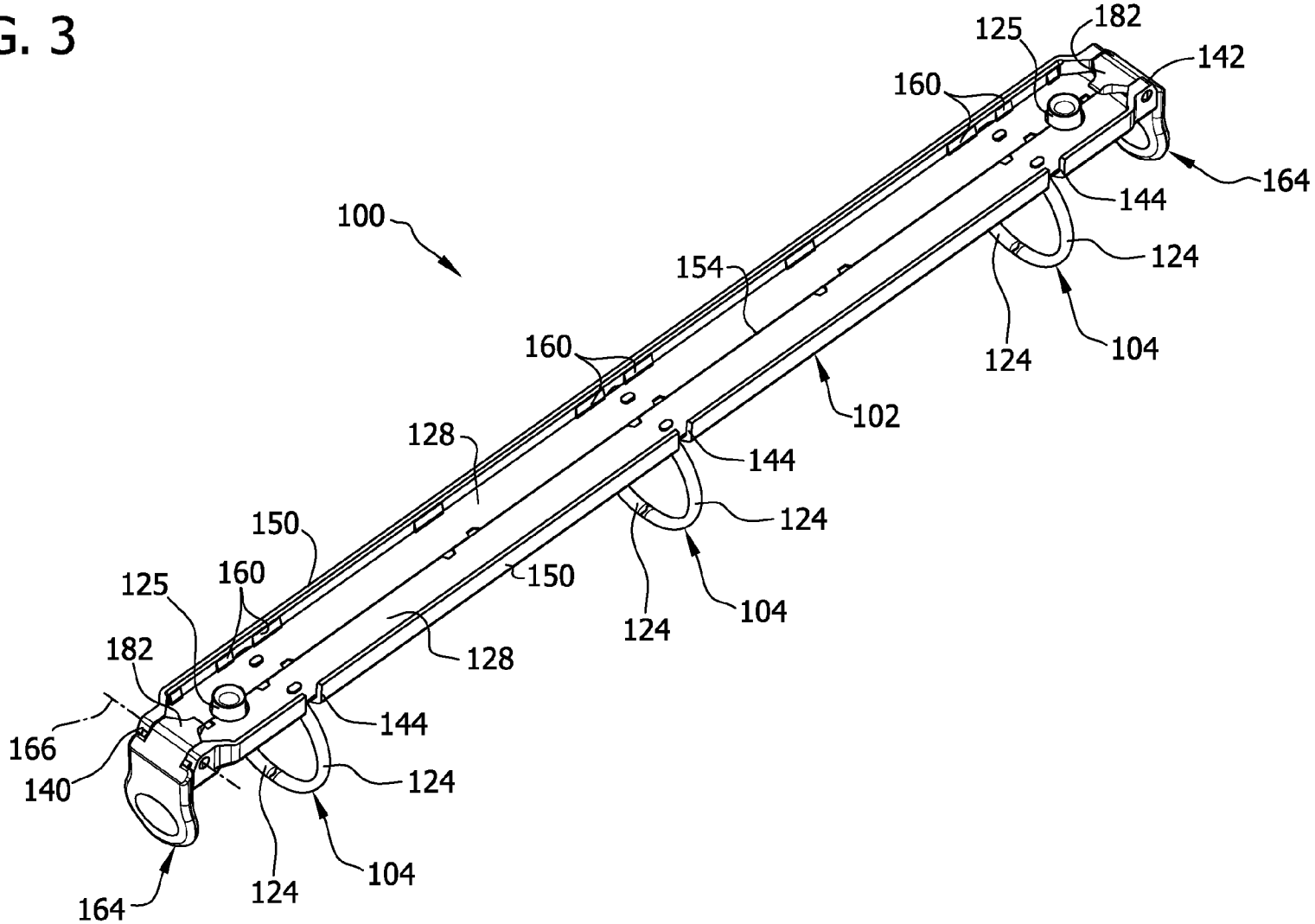
FIG. 3 is a bottom side perspective thereof.

The housing 102, as illustrated in FIG. 3, includes two mounting posts 125 for mounting the ring binder mechanism 100 on, for example, the notebook 50 of FIG. 1. Each of the mounting posts 125 is tubular having a generally cylindrical wall and a passage therein for allowing a fastener, such as the rivets 113 of FIG. 1, to pass through the housing 102. In the illustrated embodiment, one of the mounting posts 125 is positioned generally adjacent one of the longitudinal ends 140 of the housing 102 and the other mounting post is positioned generally adjacent the other longitudinal end 142. It is understood that the housing 102 can have more than two mounting posts 125 or that the housing can be mounted on a surface in a different way (i.e., using prong fasteners).

Figure 4:
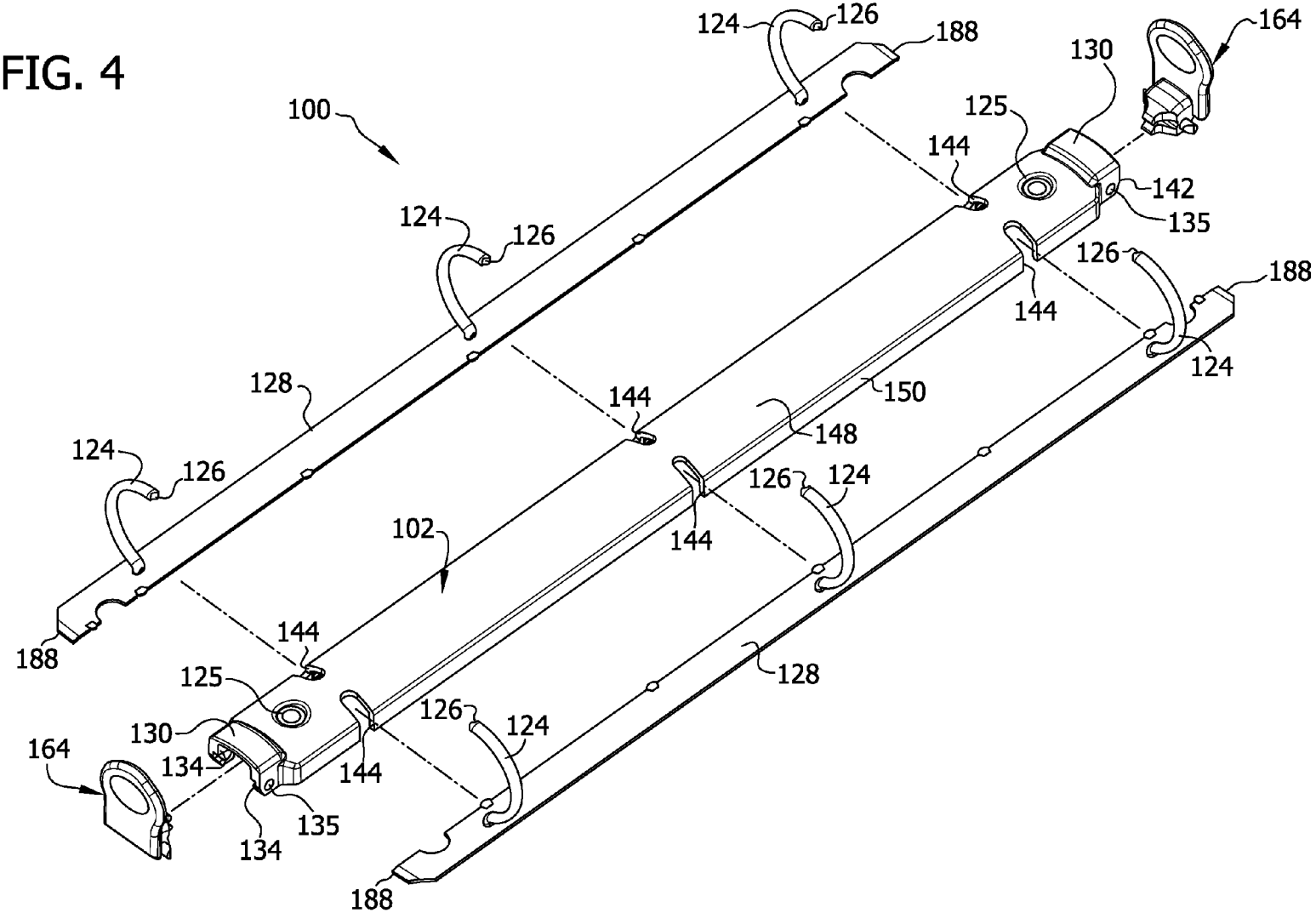
FIG. 4 is an exploded perspective of the ring binder mechanism of FIG. 1.
Figure 5:
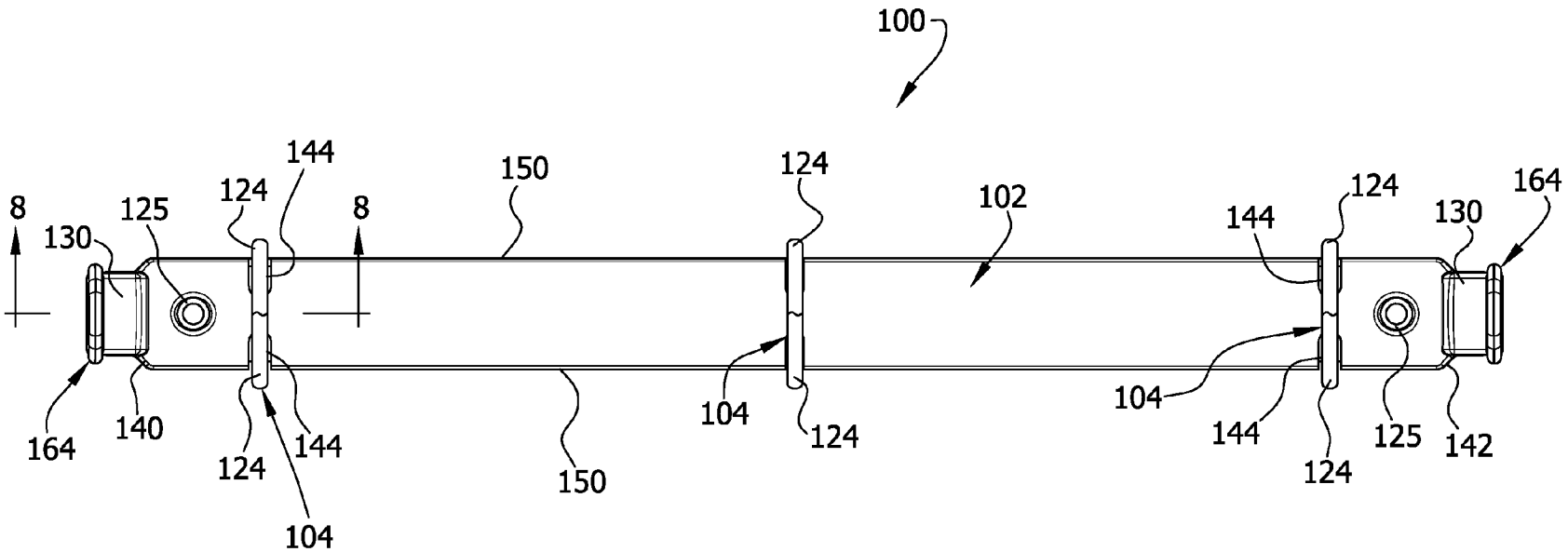
FIG. 5 is a top plan of the ring binder mechanism of FIG. 1 with rings of the mechanism illustrated in their closed position.

Referring now to FIG. 4, the housing 102 also includes a mount 130 at each of its longitudinal ends 140, 142 for mounting a respective actuator, indicated generally at 164, as described in more detail below. Each of the mounts 130 includes a pair of inward facing guide channels 134 and an opening 135 (broadly, a "seat") associated with each of the guide channels. It is understood that the openings 135 associated with the guide channels 134 can be formed as recesses.

The housing 102 further includes a plurality of openings 144 (e.g., slots, holes, or the like) spaced along the length of the housing for allowing the rings 104 to pass through the housing while supported by the hinge plates 128. In the illustrated embodiment, the housing 102 includes six openings 144 with three of the openings located along one of its lateral sides 150 and three located along the opposite lateral side. The openings 144 along one of the lateral sides (the right side of the housing as viewed in FIG. 4) are slots and the openings along the opposite lateral side are holes. It is understood, however, the housing 102 could have more or fewer openings 144 depending on the number of rings 104 and that the openings could all be formed the same (e.g., all slots, all holes).

Figure 6:
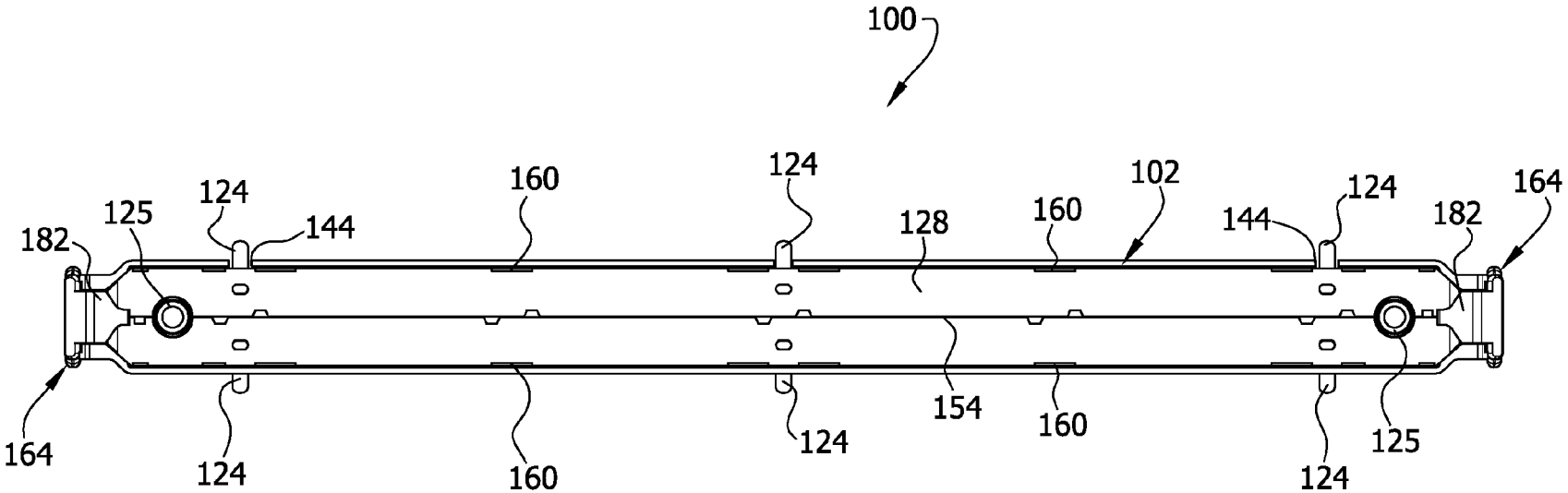
FIG. 6 is a bottom plan of the ring binder mechanism of FIG. 1.
Figure 8:
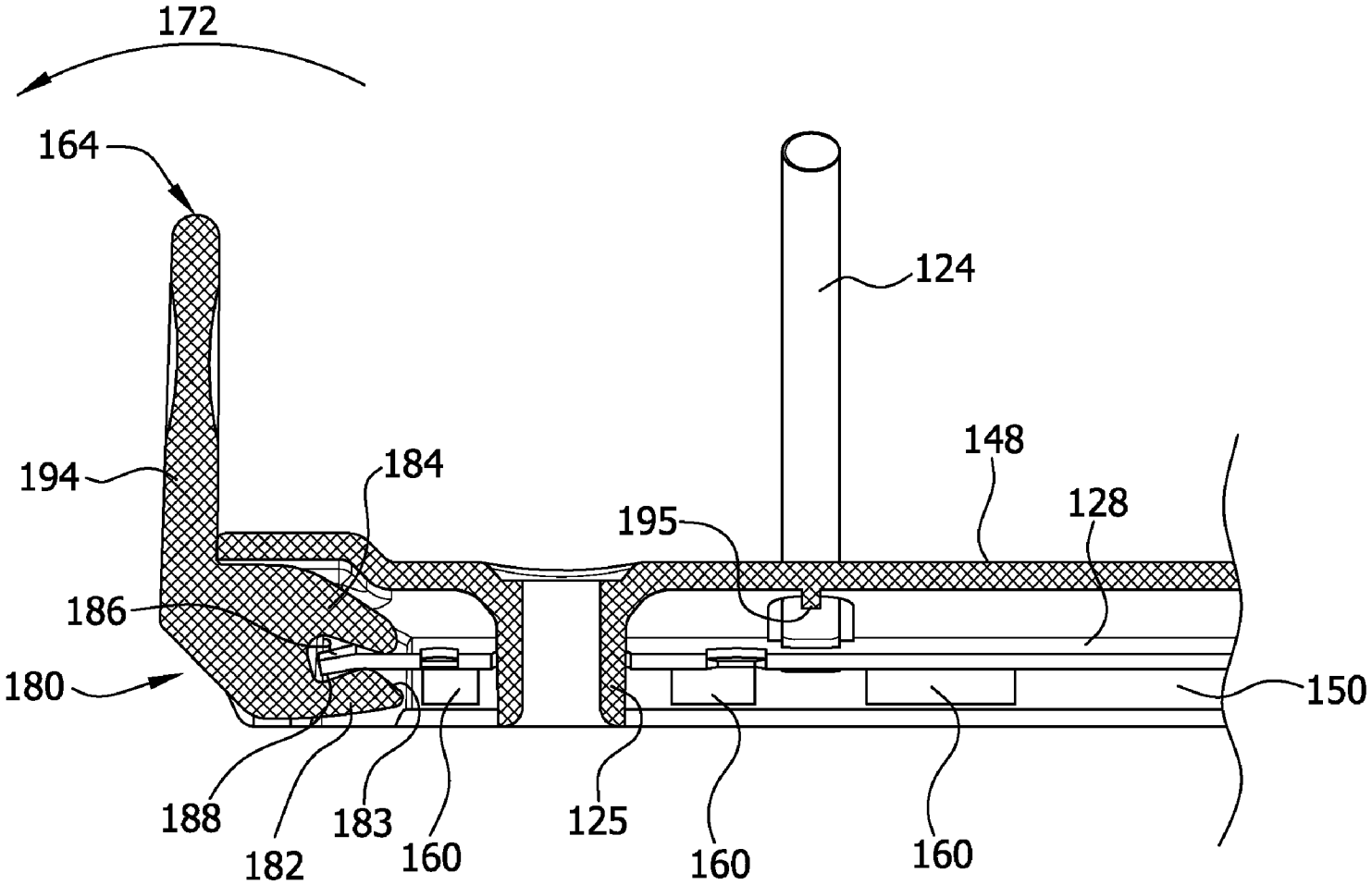
FIG. 8 is a fragmentary section of the ring binder mechanism taken in a plane including line 8-8 on FIG. 5.
Figure 13:
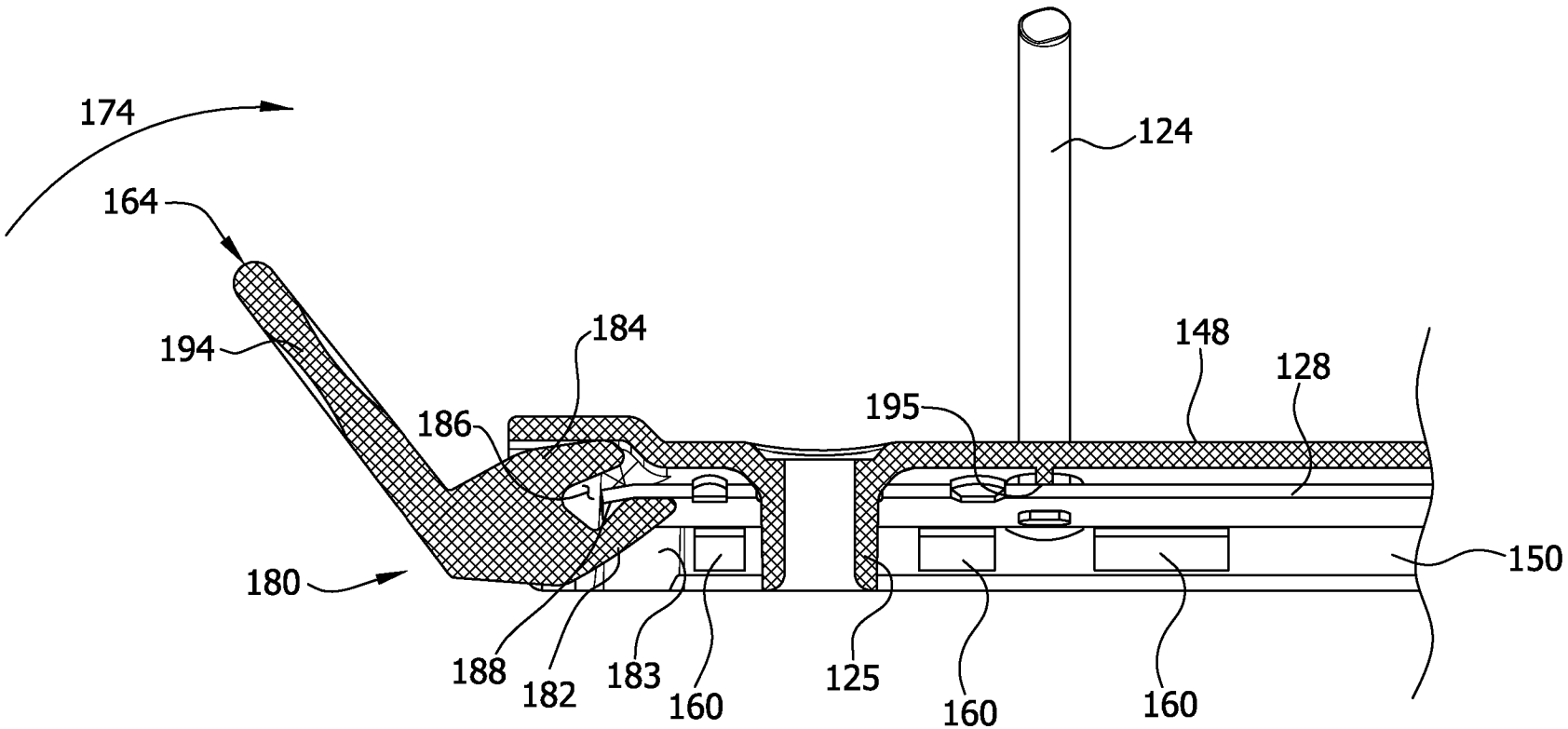
FIG. 13 is a fragmentary section of the ring binder mechanism taken in a plane including line 13-13 on FIG. 11 with the rings in their opened position.
Figure 14:
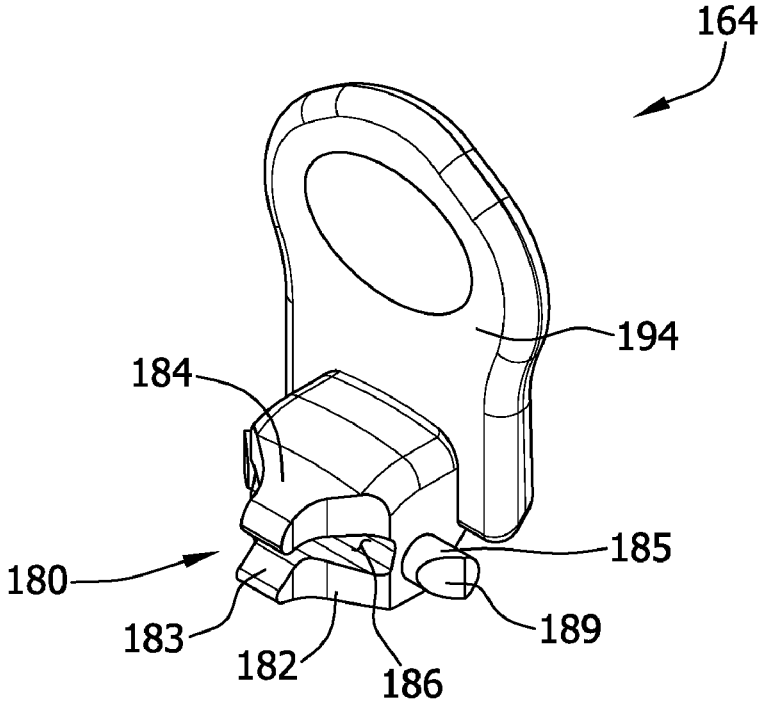
FIG. 14 is an enlarged perspective of an actuator of the ring binder mechanism of FIG. 1.
Figure 15:
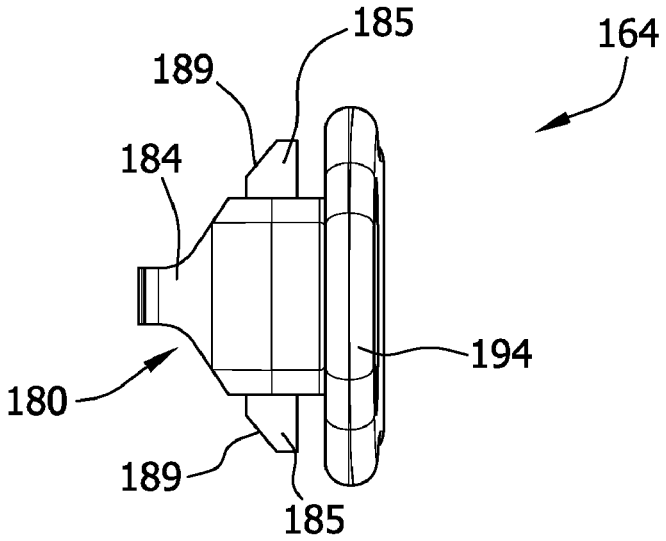
FIG. 15 is a top plan thereof.
Figure 16:
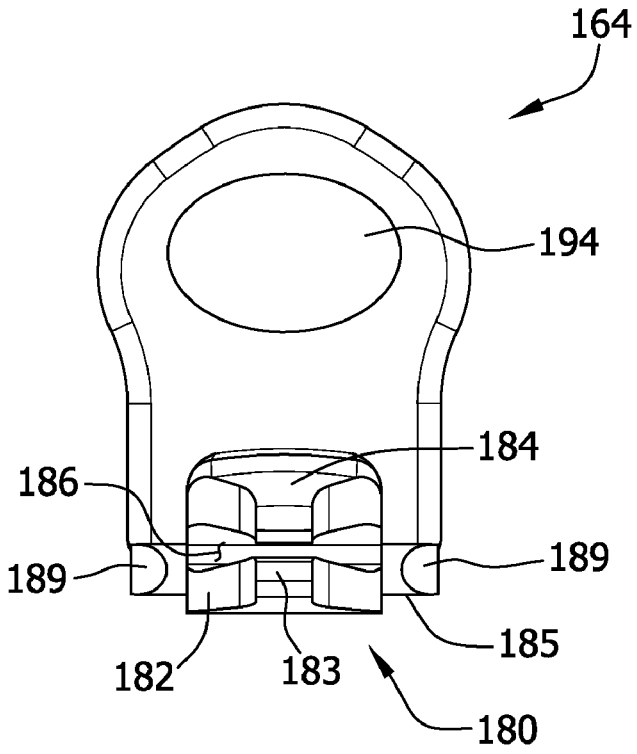
FIG. 16 is a front view thereof.
Figure 17:
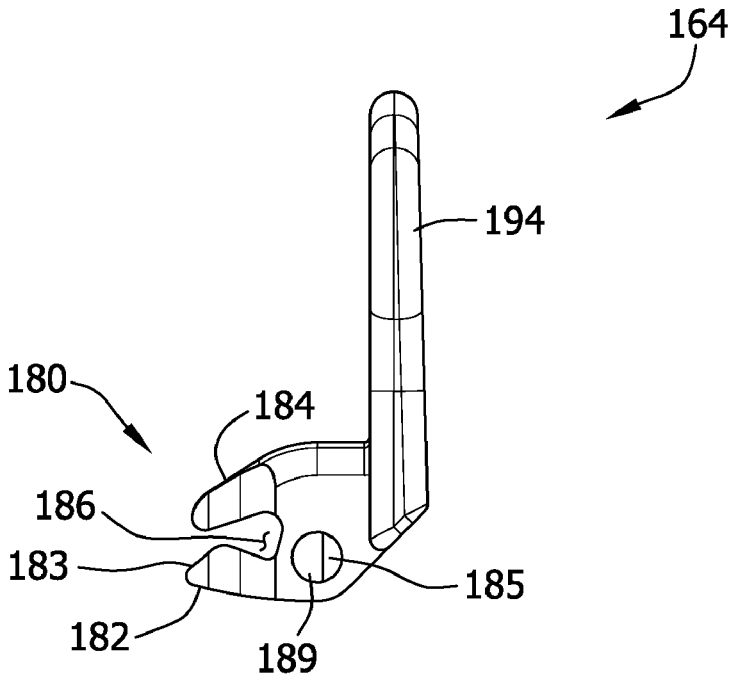
FIG. 17 is a side elevation thereof.
Figure 18:
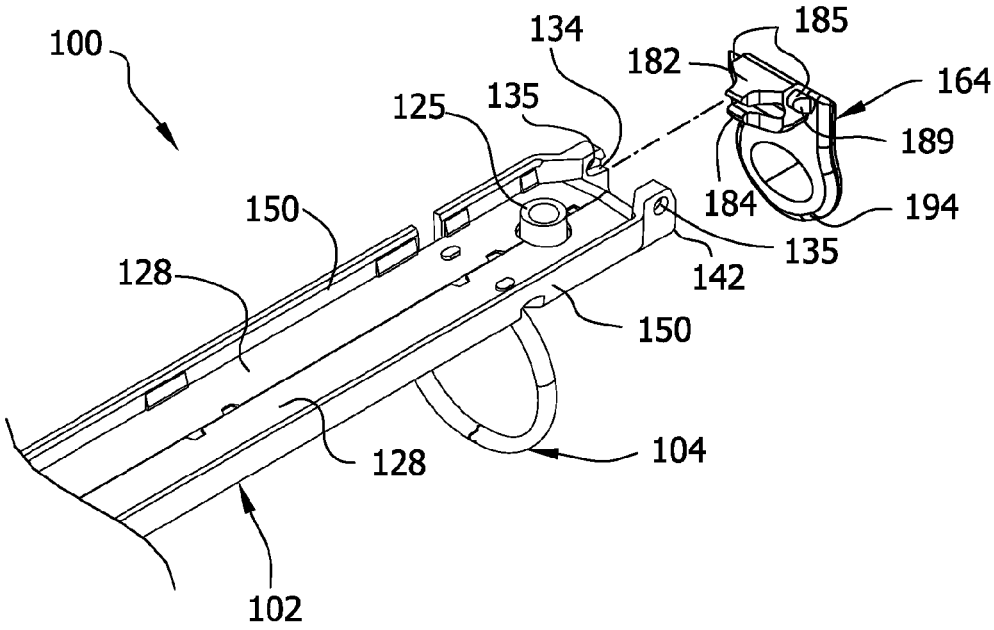
FIGS. 18-25 illustrate a method of the actuator being assembled onto the ring binder mechanism.
Figure 19:
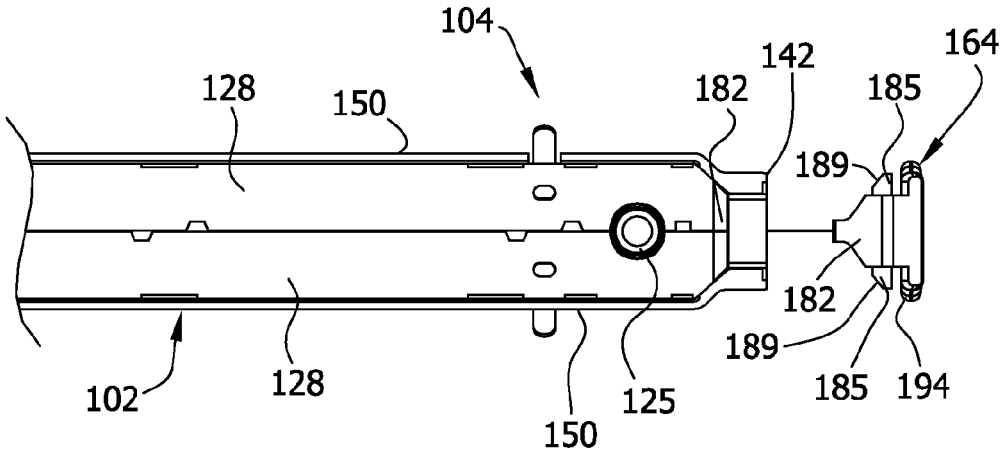
Figure 20:
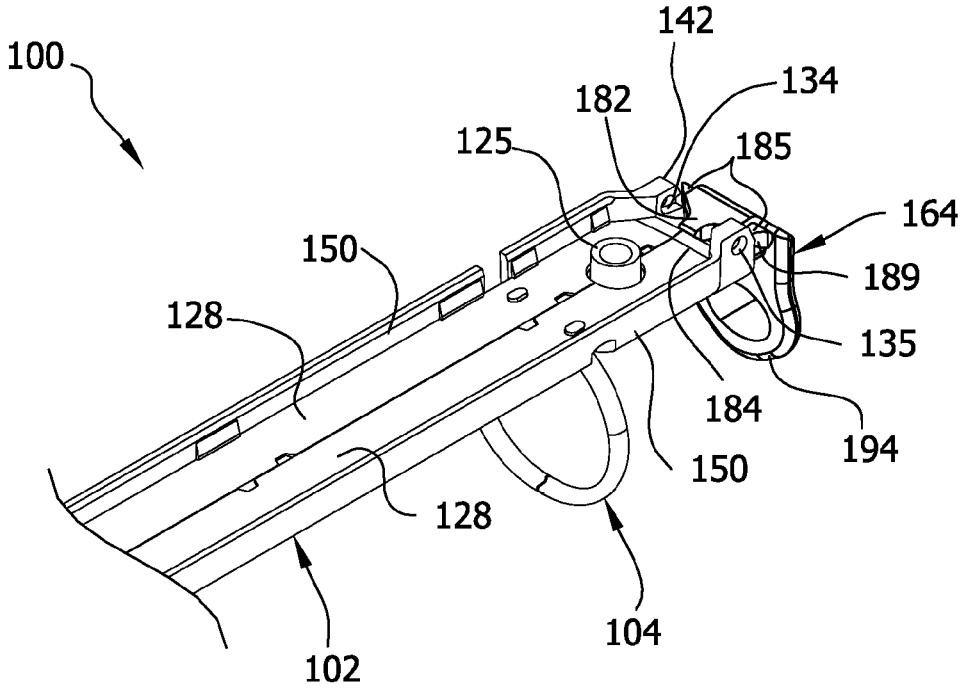
Figure 21:
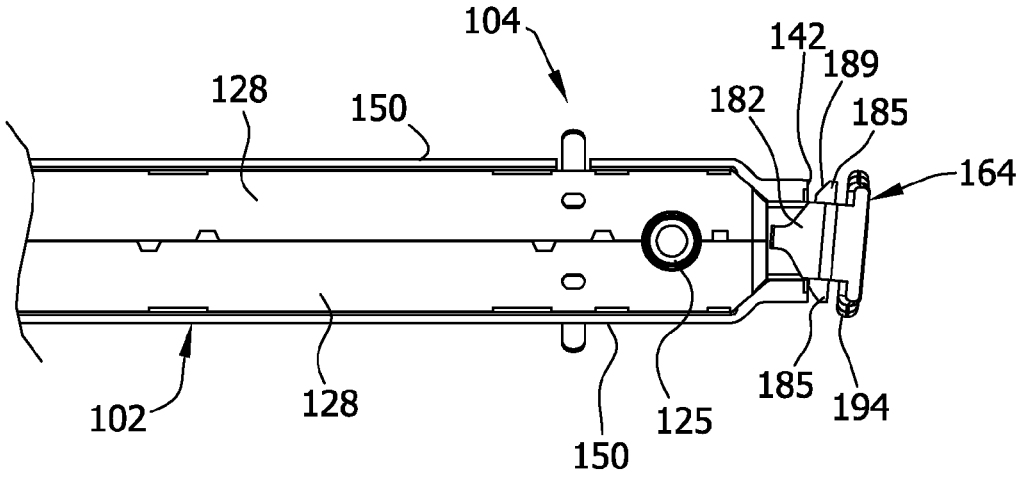
Figure 22:
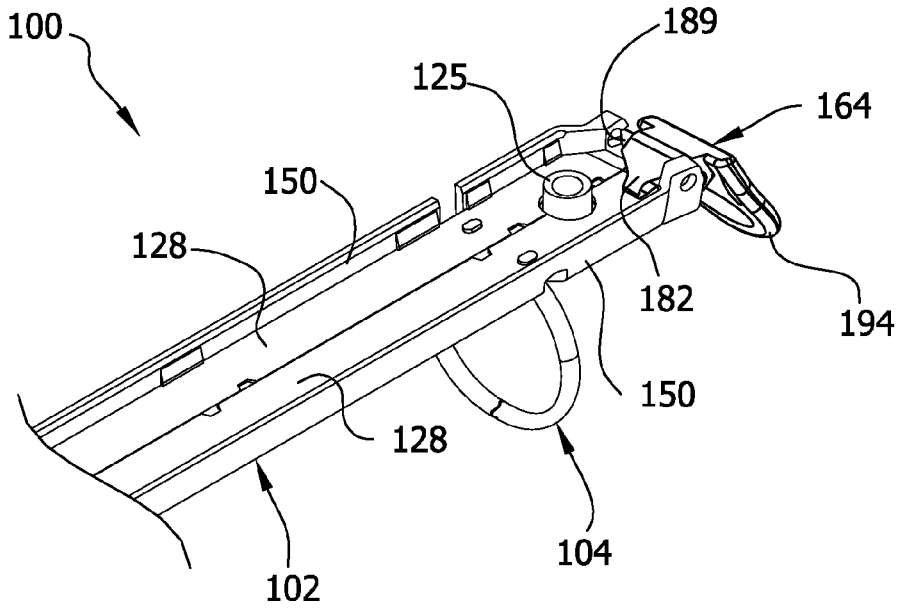

As seen in FIGS. 3 and 6, the housing 102 has a plurality of hinge plate supports 160 on each of its lateral sides 150 for securing the hinge plates 128 within the housing. Each of the hinge plate supports 160, as best seen in FIGS. 3, 8, and 13, is generally a wedge-shaped tab that includes a sloped wall and a shoulder for engaging and supporting one of the hinge plates 128. As also seen in FIGS. 8 and 13, the housing 102 includes at least one blocking member 195 extending downward from its central portion 148. The blocking member 195, as illustrated in FIG. 13, is contacted by the hinge plates 128 when the hinge plates are pivoted upward to thereby limit the upward pivotal movement of the hinge plates relative to the housing 102.

The housing 102 is designed to resiliently deform such that the spacing between the lateral sides 150 thereof increases when the hinge plates 128 pass through a coplanar position, which applies an outwardly directed force to the lateral sides of the housing. In one suitable embodiment, the housing 102 is constructed of a resilient polymeric material. For example, acrylonitrile butadiene styrene (ABS) has been found to be particularly resistant to fatigue type failure and capable of retaining its spring force over numerous cycles of operation. Because the housing 102 is constructed of a polymeric material, it can be readily fabricated in a variety of different colors, which is useful for color-coding notebooks. Additionally, printed text (either raised or imprinted) may be molded into or otherwise formed on the housing 102. Further, the polymeric material does not require nickel plating (as is usually the case with metal housings for ring binder mechanism) and is therefore agreeable to people who are sensitive to nickel.

In the illustrated embodiment, the entire housing 102 is molded as one-piece. However, the housing can be manufactured in different ways, including by being constructed in multiple pieces that are later joined together to make the housing, without departing from the scope of the invention. The housing 102 can also be made from non-polymeric (e.g., metallic) materials and be within the scope of some aspects of this invention.

As illustrated in FIG. 4, the hinge plates 128 are each generally elongate, flat, and rectangular in shape, and are shorter in length than the housing 102 so that they fit within the housing. In other words, ends 188 of each of the hinge plates 128 terminate within the housing 102. The hinge plates 128 are interconnected in side-by-side arrangement along their inner longitudinal margins, forming a central hinge 154 for pivoting movement of the hinge plates relative to one another (FIG. 6). The interconnected hinge plates 128 are disposed between the lateral sides 150 of the housing 102 such that outer edge margins of the hinge plates engage the lateral sides above the shoulders of the hinge plate supports 160, which retain the interconnected hinge plates 128 in the housing. Pivoting movement of the hinge plates 128 in the housing 102 is accompanied by movement of the central hinge 154 upward and downward relative to the housing as well as pivoting movement of outer edge margins of the hinge plates relative to lateral sides 150 of the housing.

Figure 2:
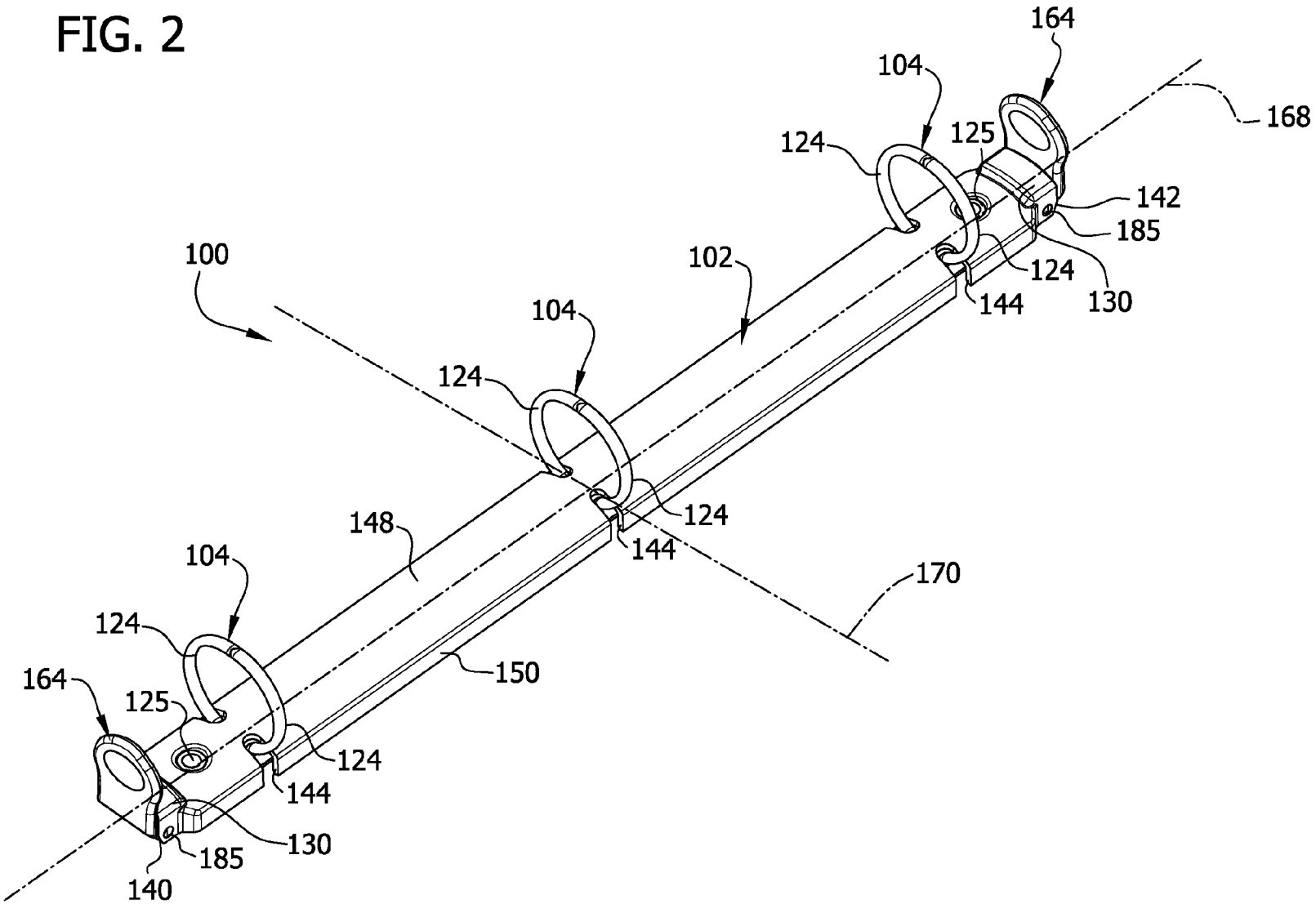
FIG. 2 is a top side perspective of the ring binder mechanism of FIG. 1 removed from the notebook.
Figure 9:
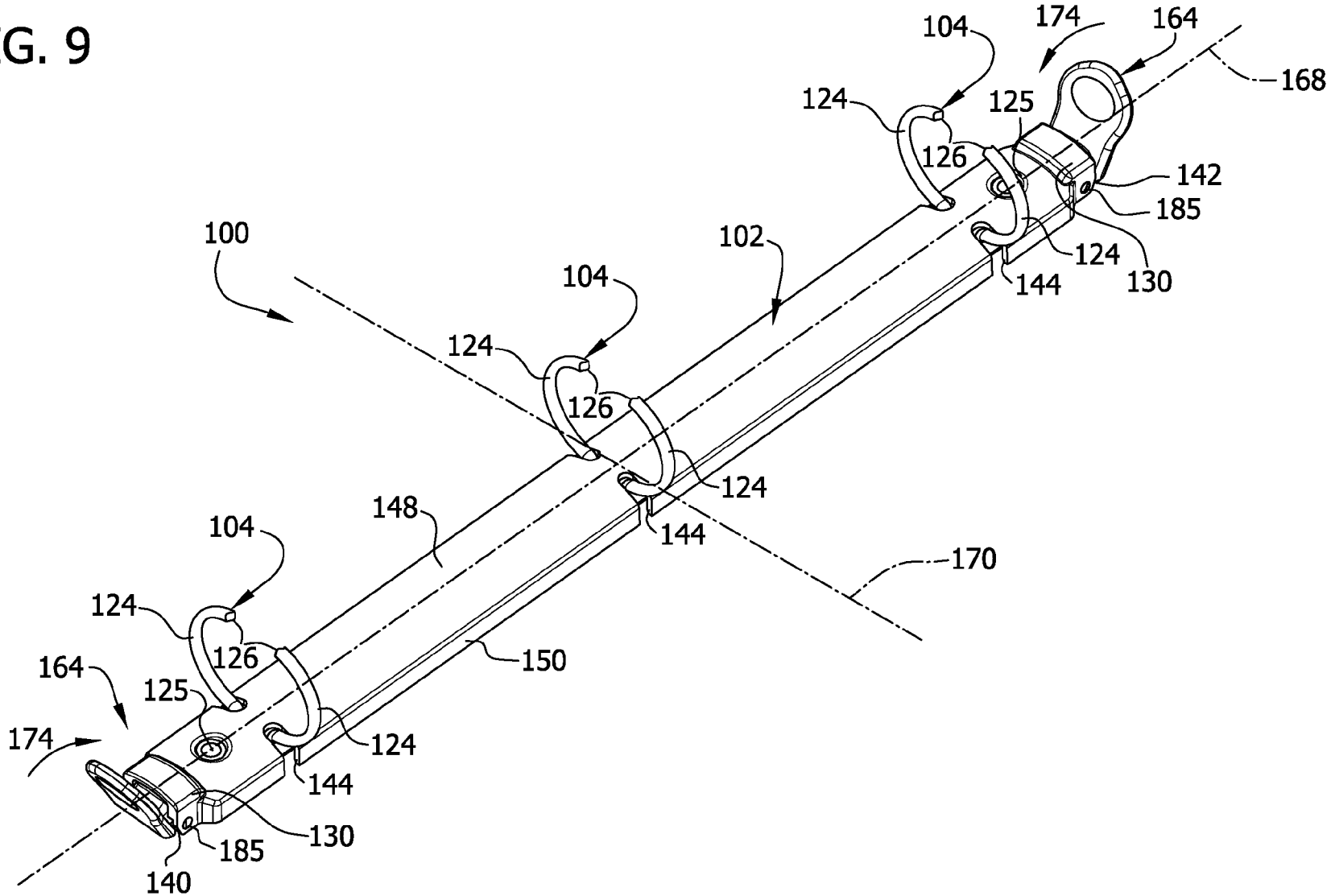
FIG. 9 is a top side perspective of the ring binder mechanism of FIG. 1 with the rings in their opened position.

Each of the rings 104 are adapted to retain loose-leaf pages (not shown) on the ring binder mechanism 100. The three rings 104 of the illustrated ring binder mechanism 100 are substantially similar and are each generally circular in shape (FIG. 2). As seen in FIG. 2, each ring 104 includes two generally semi-circular ring members 124 formed from a conventional, cylindrical rod of a suitable material (e.g., steel). The ring members 124 include free ends 126 that are formed to secure the ring members against misalignment when they are closed together (FIG. 9). The rings 104 can be D-shaped as is known in the art, or shaped otherwise within the scope of this invention. Ring binder mechanisms with ring members formed of different material or having different cross-sectional shapes, for example, oval shapes, do not depart from the scope of this invention. Likewise the number of rings supported by the housing can also vary within the scope of the invention.

With reference again to FIG. 4, one ring member 124 of each ring 104 is mounted on one of the interconnected hinge plates 128, while the other ring member of that ring is mounted on the opposite hinge plate. The ring members 124 extend through the openings 144 in the housing 102 and are arranged so their free ends 126 face toward one another above the housing 102 (FIG. 2). The ring members 124 are moveable between an opened position (FIG. 9) in which loose-leaf pages can be added to and/or removed from the ring binder mechanism 100 and a closed position (FIG. 2) in which the free ends 126 of corresponding ring members 124 are joined to retain any loose-leaf pages on the rings 104 in the ring binder mechanism. In the illustrated ring binder mechanism 100, both ring members 124 of each ring 104 moves with the pivoting movement of the respective hinge plate 128. It is understood, however, that the ring binder mechanism 100 can have one movable ring member 124 and one fixed ring member without departing from the scope of this invention (e.g., a mechanism in which only one of the ring members of each ring is mounted on a hinge plate with the other ring member mounted on the housing).

The housing 102 is suitably deformed in the opened and closed positions of the rings 104 so that the housing continuously applies a spring force to the hinge plates 128 for holding the rings in either their opened position or their closed position. Other constructions for biasing the hinge plates 128 or otherwise holding the rings 104 in their opened and/or closed positions may be used within the scope of the present invention.

The illustrated ring binder mechanism 100 includes two actuators 164 operable to move the rings 104 from their closed position to their opened position and from their opened position back to their closed position. With reference to FIGS. 14-17, each of the actuators 164 in the illustrated embodiment of the ring binder mechanism 100 has a yoke portion, indicated generally at 180, including a lower arm 182 and an upper arm 184. Each of the actuators 164 also includes a lever arm 194 extending upward from the yoke portion 180 to a location spaced from the housing 102 for use in gripping and pivoting of the actuator by a user. The yoke portion 180 of each of the actuators 164 comprises a unitary body forming the upper and lower arms 182, 184. The unitary body also includes at least a portion of the lever arm 194, which may also include an elastomeric cover or grip portion (not shown) within the scope of the invention. In the illustrated embodiment, the actuators 164 are formed from the same material (e.g., acrylonitrile butadiene styrene (ABS)) as the housing 102. It is understood, however, that the actuators 164 and the housing 102 can be formed from different materials.

The upper and lower arms 182, 184 together define a notch 186 therebetween. The lower arm 182 of the yoke portion 180 of the actuator 164 has a beveled outer edge 183 (broadly, "a contact surface") that is configured for engagement with the lower surface of the hinge plates 128. As illustrated in FIGS. 8 and 13, the lower arm 182 of the yoke portion 180 extends between the lateral sides 150 of the housing 102 to a location adjacent the hinge plates 128 and on a side of the hinge plates opposite the central portion 148 of the housing for engaging a bottom surface of the hinge plates during pivoting movement of the respective actuators 164 to open the rings 104. Particularly, as the actuators 164 are pivoted to open the rings 104, the beveled outer edge 183 of the respective lower arm 182 rotates from a position with little or no engagement with the lower surface of the hinge plates 128 (FIG. 8) to a position in engagement with the lower surface of the hinge plates (FIG. 13). The upper arm 184 of the yoke portion 180 extends between the lateral sides 150 of the housing 102 to a location adjacent the upper surface of the hinge plates 128 (FIGS. 8 and 13). That is, the upper arm 184 is located on a side of the hinge plates opposite the lower arm 182. As illustrated in FIGS. 8 and 13, the ends 188 of each of the hinge plates 128 are received in the notches 186 of the yoke portions 180 of the respective actuator 164.

With reference again to FIGS. 14-17, the yoke portions 180 of each of the actuators 164 includes a pair of pivot members 185 extending laterally outward therefrom. Each of the pivot members 185, which are generally cylindrical, has a free end that is spaced from the yoke portion 180 of the respective actuator 164. The free ends of the pivot members 185 each include an angled or beveled surface 189. While the angled surfaces 189 of the pivot members 185 are illustrated as being generally flat, it is understood that they can be arcuate having either a generally convex or concave surface.

The actuators 164 are mounted at respective ends 140, 142 of the housing 102 for pivotal movement of the actuator relative to the housing about a pivot axis 166. More specifically, in the illustrated embodiment, each of the actuators 164 are mounted to the housing 102 at respective mounts 130 and the pivot members 185 of the actuators are aligned with and extend through respective openings 135 formed in the mounts of the housing. It is understood that in another embodiment, the openings (or seats) can be formed in the actuator and the pivot members can be mounted on an inner surface of the lateral sides of the housing. As illustrated in FIGS. 2 and 3, the pivot members 185, which define the pivot axis 166 of the actuators 164, are substantially perpendicular to a longitudinal axis 168 of the housing 102 and substantially parallel to a lateral axis 170 of the housing (e.g., an axis that is orthogonal to the longitudinal axis and oriented so it extends through each of the lateral sides 150 of the housing).

Figure 7:
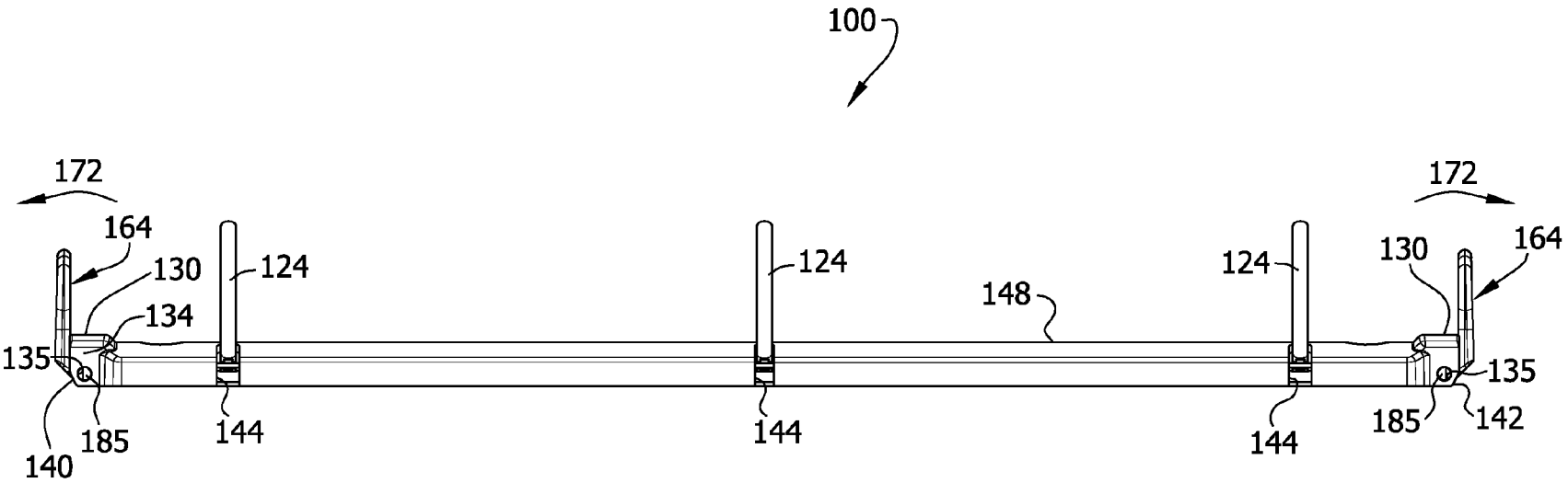
FIG. 7 is a side elevation thereof.
Figure 10:
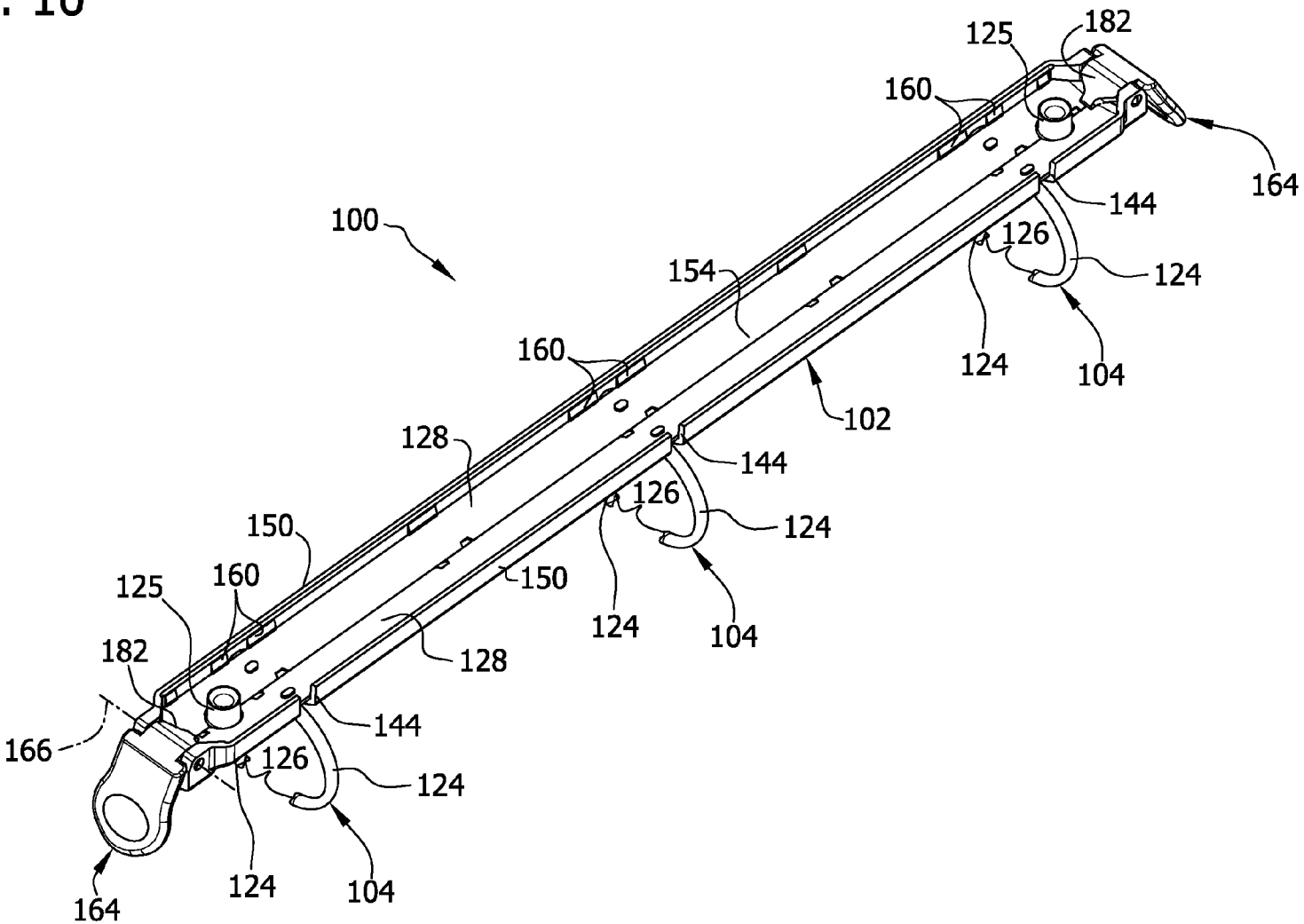
FIG. 10 is a bottom side perspective thereof with the rings in their opened position.
Figure 11:
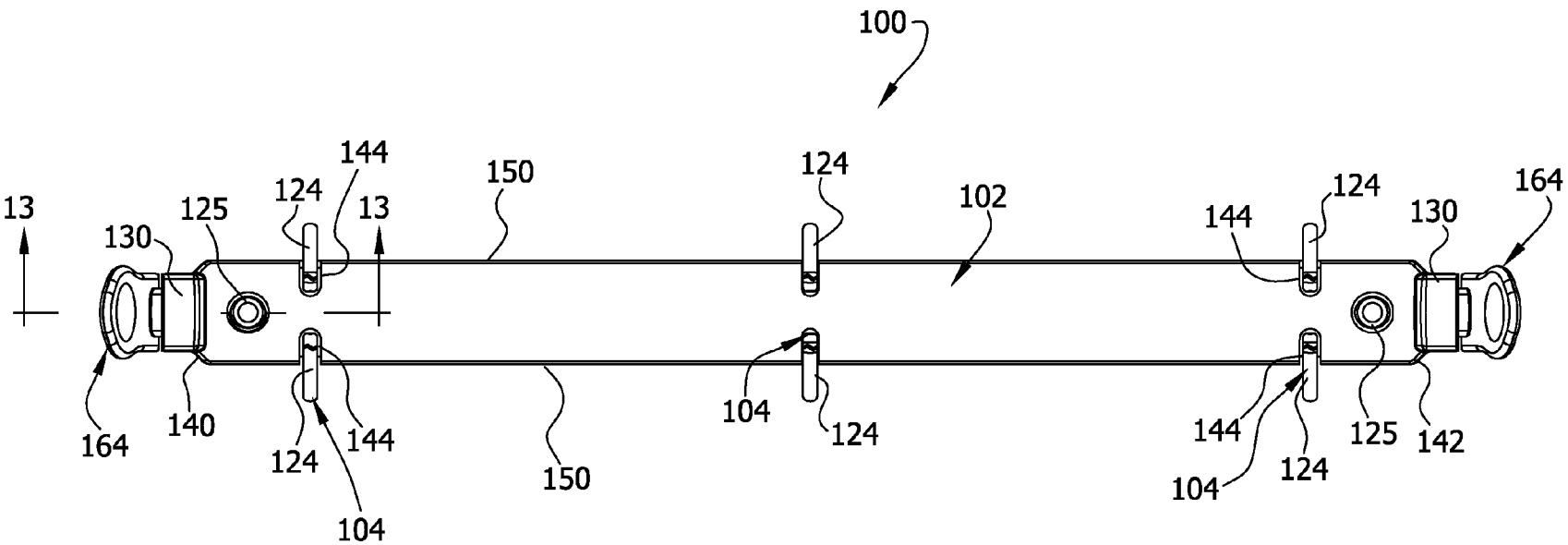
FIG. 11 is a top plan thereof with the rings in their opened position.
Figure 12:
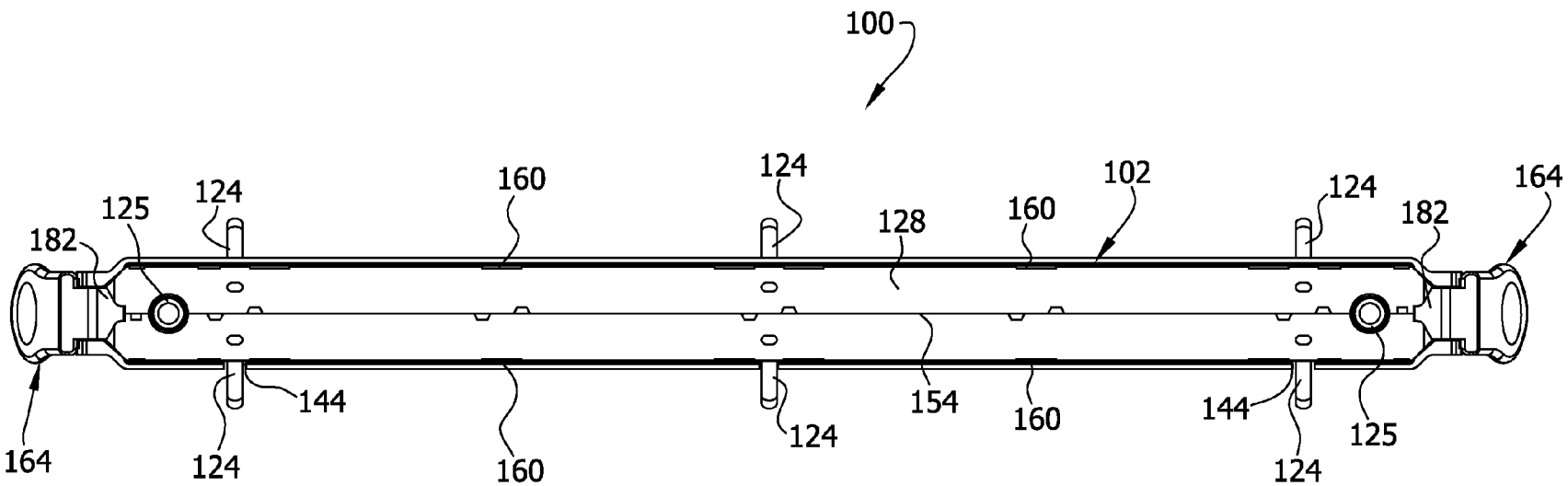
FIG. 12 is a bottom plan thereof with the rings in their opened position.

The actuators 164 are positioned and arranged so that pivoting movement of the actuators about the respective pivot axis 166 in the directions of arrows 172 shown on FIGS. 7 and 8 causes the beveled outer edges 183 of the lower arms 182 of the respective actuators to engage the hinge plates 128 and move the central hinge 154 of the hinge plates upward in the housing 102. Upward movement of the hinge plates 128 causes the rings 104 to move from their closed position to their opened position. The hinge plates 128 are illustrated in an upward position in FIGS. 10, 12, and 13.

In the illustrated embodiment, the actuators 164 are also positioned and arranged so that pivoting movement of the actuator about the pivot axis 166 in the reverse direction (indicated by the arrow 174 on FIGS. 10 and 13) when the rings 104 are open causes the upper arms 184 of the respective actuators to engage the hinge plates 128 and move the central hinge 154 downward in the housing 102, thereby pivoting the hinge plates downward and causing the rings to move from their opened position to their closed position. The hinge plates 128 are illustrated in a downward position in FIGS. 3, 6, and 8.

It is understood that the ring binder mechanism 100 can be formed with a single actuator instead of the two seen in the accompanying drawings. It is also understood that while two actuators 164 are provided on the illustrated ring binder mechanism 100 only one may be needed to move the hinge plates 128 between their downward and upward positions. That is, the rings 104 can be moved between the opened and closed positions using either one of the two actuators 164. In the illustrated embodiment, however, both actuators 164 have to be pivoted simultaneously to pivot the hinge plates 128 and thereby move the rings 104 between their opened and closed positions. It is further understood that the rings 104 can be moved between their opened and closed position by manually pulling the rings apart or pushing the rings together.

In use, when a user wants to open the rings 104, he or she can grasp the lever arms 194 of the actuators 164 and pivot both of the actuators in the direction of the arrows 172 shown in FIGS. 7 and 8. This causes the lower arms 182 of the yoke portions 180 of the actuators 164 to engage the lower surface of the hinge plates 128. As the user continues to pivot the actuators 164, the lower arm 182 pushes the central hinge 154 of the hinge plates 128 upward in the housing 102, thereby causing the hinge plates to pivot relative to one another and the housing. The ring members 124 pivot with the respective hinge plate 128, thereby moving the rings 104 from their closed position to their opened position. The beveled outer edge 183 of the respective lower arms 182 rotates from a position with little or no engagement with the lower surface of the hinge plates 128 (FIG. 8) to a position in engagement with the lower surface of the hinge plates (FIG. 13). The positive engagement between the lower surface of the hinge plates 128 and the beveled outer edge 183 of the lower arm 182 inhibits the respective actuators 164 from disengaging from the hinge plates. The beveled outer edge 183 increases the amount of surface area of the actuator 164 that contacts the hinge plates 128 when the hinge plates are pivoted upward to open the rings 104.

When the user wants to close the rings 104, he or she can grasp the lever arm 194 and use it to pivot the actuators 164 in the direction of the arrows 174 (FIGS. 9 and 13). This causes the upper arm 184 of the actuator 164 to engage the upper surface of the hinge plates 128. As the user continues to pivot the actuators 164 in the direction of the arrow 174, the upper arm 184 pushes the central hinge 154 of the hinge plates 128 downward in the housing 102, causing the hinge plates to pivot relative to one another and the housing. The ring members 124 pivot with the hinge plates 128 thereby moving the rings 104 to their closed position.

FIGS. 18-25 illustrate a method of snapping one of the actuators 164 onto one of the longitudinal ends 142 of the housing 102 during the manufacturing of the ring binder mechanism 100 described above and seen in FIGS. 1-17. With reference to FIGS. 18-21, the actuator 164 is brought adjacent to and into alignment with the respective longitudinal end 142 of the housing 102 so that each of the pivot members 185 are aligned with a respective one of the guide channels 134 formed in the lateral sides 150 of the housing. Next, one of the pivot members 185 of the actuator 164 (the right pivot member as viewed in the FIGS. 20 and 22) is inserted into and slid along the respective guide channel 134 of the housing 102 until the pivot member 185 is inserted into the corresponding opening 135 formed in the housing. As mentioned above, each of the guide channels 134 formed in the lateral sides 150 of the housing 102 extend from the longitudinal end 142 of the housing to one of the openings 135. The angled surface 189 of each of the pivot members 185 facilitates alignment, insertion, and sliding of the pivot members of the actuator 164 through the guide channels 134.

Figure 23:
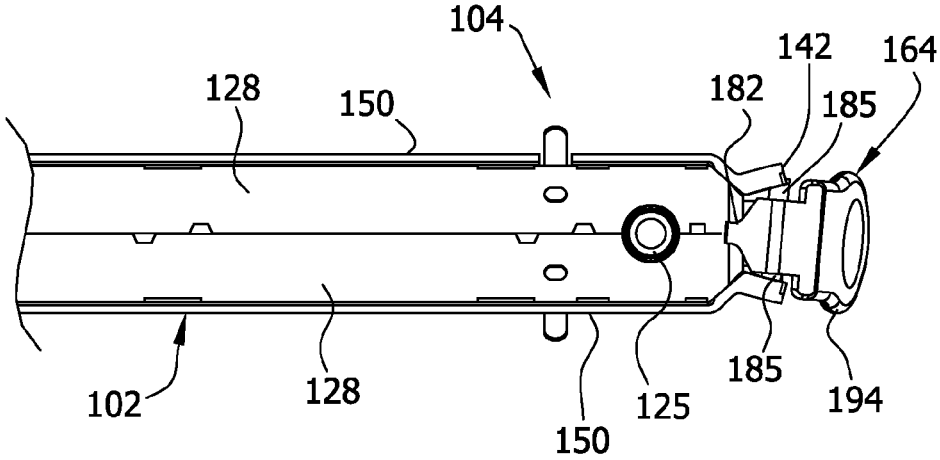

With one of its pivot members 185 inserted into a corresponding opening 135, the actuator 164 is canted with respect to the housing 102. The other pivot member 185 (the left pivot member as viewed in FIGS. 20 and 22) is then inserted into and slid along the corresponding guide channel 134, which causes the lateral sides 150 of the housing adjacent the longitudinal end 142 thereof to spread apart (FIG. 23). The width of the actuator 164 measured laterally along the pivot members 185 is substantially greater than the width of the housing measure between the inner surfaces of its lateral sides 150. As the actuator 164 is slid further inward along the housing 102, the angled surface 189 of the pivot member 185 facilitates the spreading of the lateral sides 150 of the housing 102. The lateral sides 150 of the housing 102 are spread apart the farthest just before the pivot member 185 snaps into the corresponding opening 135 in the housing.

Figure 24:
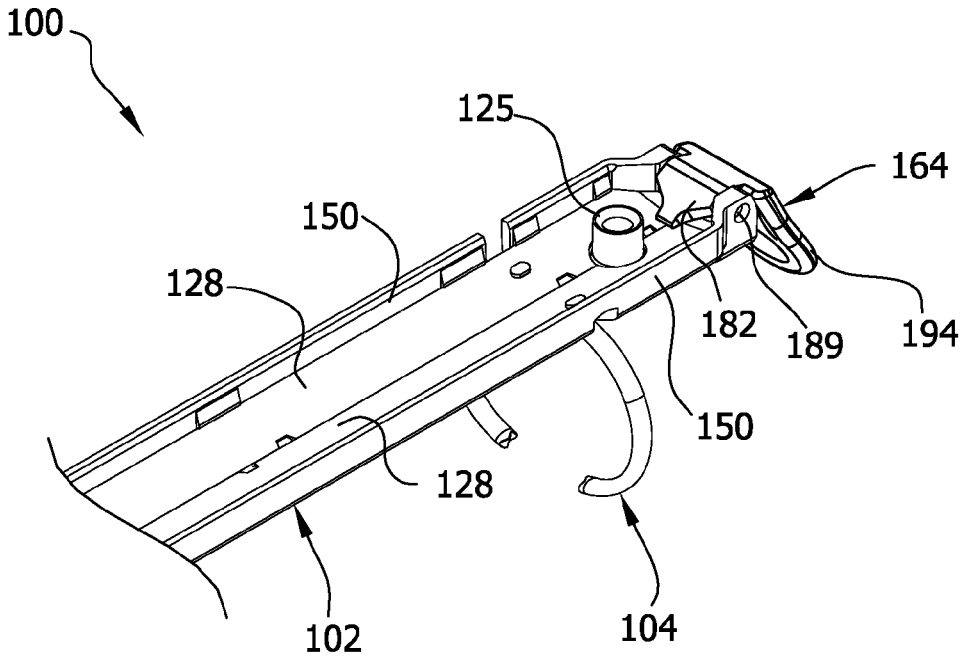
Figure 25:
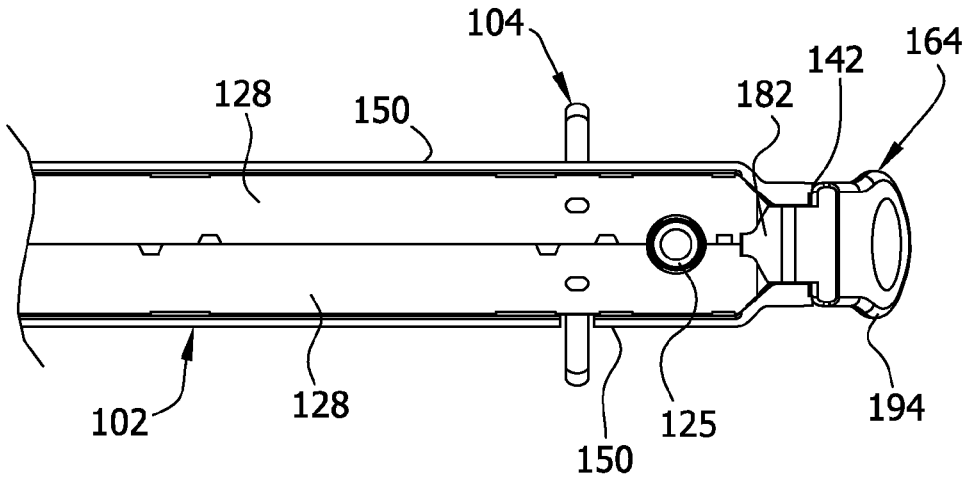

Upon insertion of the pivot member 185 of the actuator 164 into the opening 135, the resiliency of the housing 102 causes the lateral sides 150 to return to substantially their original, un-spread configuration as illustrated in FIGS. 24 and 25. Once both of the pivot members 185 are in the opening 135 of the housing 102 and the lateral sides 150 of the housing have returned to their original configuration, the actuator is securely mounted on the housing for pivotal movement thereof. It is understood that, in another embodiment, both of the pivot members 185 can be aligned with, inserted into, and slide along the corresponding guide channels 134 so that both of the pivot members 185 snap into the respective opening 135 almost simultaneously.

As seen in FIGS. 24 and 25, the actuator 164 engages the hinge plates 128 as it is inserted onto the housing 102. More specifically, both of the hinge plates 128 are captured between upper and lower arms 184, 182 of the actuator 164 as illustrated in FIGS. 8 and 13.

Thus, the actuator 164 can be easily and quickly snapped onto the housing 102 during the manufacture of the ring binder mechanism 100. In the present embodiment, the actuator 164 has a snap-lock connection with the housing 102. That is, once the actuator 164 is mounted on the housing 102 manual removal of the actuator from the housing is inhibited. The actuator 164 located at the opposite longitudinal end 140 of the housing 102, as seen in FIG. 2, can be snapped onto the housing in the same manner.

When introducing elements of the present invention or the preferred embodiments thereof, the articles "a", "an", "the" and "said" are intended to mean that there are one or more of the elements. The terms "comprising", "including," and "having" are intended to be inclusive and mean that there may be additional elements other than those listed.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A ring binder mechanism for holding loose-leaf pages, the mechanism comprising:

an elongate housing;

a ring support supported by the housing for movement relative to the housing, the ring support having an upper surface and a lower surface;

a plurality of rings for holding the loose-leaf pages, each ring including a first ring member and a second ring member, the first ring member being mounted on the ring support for movement with the ring support relative to the housing between a closed position and an opened position, in the closed position the first and second ring members cooperatively forming a substantially continuous, closed loop for allowing loose-leaf pages retained by the rings to be moved along the rings from one ring member to the other, and in the opened position the first and second ring members forming a discontinuous, open loop for adding or removing loose-leaf pages from the rings; and an actuator mounted on the housing for pivotal movement relative to the housing for moving the rings from their closed position to their opened position, the actuator having a snap-lock connection with the housing, wherein the actuator further comprises pivot members extending from opposite sides of the actuator and having free ends, the actuator is mounted on the housing for pivoting movement about the pivot members, and the free ends of the pivot members are beveled.

2. The ring binder mechanism set forth in claim 1 wherein the housing has longitudinal ends and a pair of openings located adjacent at least one of the longitudinal ends, the pivot members of the actuator being respectively received in the openings in the housing.

3. The ring binder mechanism set forth in claim 2 wherein each of the pivot members of the actuator includes an angled surface at the beveled end for facilitating the snap-lock connection between the actuator and housing.

4. The ring binder mechanism set forth in claim 2 wherein the housing includes a pair of guide channels, the guide channels extending between one of the longitudinal ends of the housing and a respective one of the openings in the housing.

5. The ring binder mechanism set forth in claim 1 wherein the housing is constructed of a polymeric material.

6. The ring binder mechanism set forth in claim 5 wherein the actuator is constructed of a polymeric material.

7. The ring binder mechanism as set forth in claim 1 wherein the ring support comprises a pair of hinge plates in generally side-by-side relation and hingedly connected to one another for pivoting movement relative to each other.

8. The ring binder mechanism as set forth in claim 1 wherein the ring binder mechanism has two actuators, each actuator being mounted on a respective longitudinal end of the housing.

9. The ring binder mechanism as set forth in claim 1 in combination with a cover, the ring binder mechanism being mounted on the cover and the cover being hinged for movement to selectively cover and expose any loose-leaf pages held by the ring binder mechanism.

10. The ring binder mechanism set forth in claim 1 wherein the actuator has an upper arm and a lower arm for engaging the ring support to close and open the rings, respectively.

11. The ring binder mechanism set forth in claim 10 wherein the upper and lower arms are part of a yoke of the actuator and form a notch, the ring support being partially received in the notch.

12. The ring mechanism set forth in claim 1 wherein the housing comprises a top and sides extending down from opposite sides of the top and the housing a has a pair of guide channels, the guide channels extending longitudinally from the end of the housing along the sides of the housing to the openings.

* * * * *